US006328163B1

(12) United States Patent
Coleman et al.

(10) Patent No.: US 6,328,163 B1
(45) Date of Patent: Dec. 11, 2001

(54) MORPHING CANDY HOLDING DEVICE

(76) Inventors: Thomas J. Coleman, 19170 Paddock Pl., Abingdon, VA (US) 24211; William K. Schlotter, IV, 117 Wateredge La., Fredericksburg, VA (US) 22406; Princess Ann Coleman, 19170 Paddock Pl., Abingdon, VA (US) 24211; Ann M. Schlotter, 117 Wateredge La., Fredericksburg, VA (US) 22406

( * ) Notice: Subject to any disclaimer, the term of this patent is extended or adjusted under 35 U.S.C. 154(b) by 0 days.

(21) Appl. No.: 09/503,339

(22) Filed: Feb. 14, 2000

(51) Int. Cl.[7] ..... B65D 73/00

(52) U.S. Cl. ..... 206/457; 446/337; 446/475; 426/104; 426/134; 40/442

(58) Field of Search ..... 206/457; 446/321, 446/337, 485, 475; 426/104, 134, 110, 115; 428/7; 40/442, 541, 540, 555; 362/154, 253

(56) References Cited

U.S. PATENT DOCUMENTS 1,933,596 * 11/1933 MacLean ..... 426/110
4,888,667 * 12/1989 Hwang ..... 362/109
5,531,318 * 7/1996 Coleman et al. ..... 206/738
6,077,144 * 6/2000 Fishman ..... 446/236
6,183,336 * 2/2001 Coleman et al. ..... 446/267

* cited by examiner

*Primary Examiner*—Paul T. Sewell
*Assistant Examiner*—Shian Luong
(74) *Attorney, Agent, or Firm*—Melvin L. Crane

(57) ABSTRACT

A morphing candy holding device including a main housing with a primary chamber and a second chamber. The primary chamber includes an aperture through which a piece of candy secured in the primary chamber can be pushed for consumption by a consumer. A lower housing includes a candy stick holder in the primary chamber which pushes the candy up through the aperture for consumption. The secondary electrical circuit includes a power source, an integrated circuit, a control switch for controlling the electrical circuitry. The electrical circuitry in addition to the integrated circuit includes four LED lights which are in a series from a bottom of the secondary chamber to an upper end of the chamber. The LED lights shine through a series of transition pictures which change from one form to another form from the lower end of the secondary chamber to the upper end of the secondary chamber. Lowering the lower housing inactivates the electrical switch.

10 Claims, 1 Drawing Sheet

MORPHING CANDY HOLDING DEVICE

This invention is directed to a morphing candy holding device and more particularly to a candy holding device which stores a piece of candy that is pushed from the housing for consumption. The housing is provided with a series of partial pictures along a length of the housing which are backed by a series of LEDs so that the pictures are visibly displayed by the lights as the lights are triggered in succession which has an appearance of a transformation from a person to an animal or any other transformation desired.

BACKGROUND OF THE INVENTION

Heretofore applicants have obtained U.S. Pat. No. 5,531,318 which pushes a piece of candy from a housing for consumption by a consumer.

Other devices such as lipstick dispensers have been patented by which a lipstick material is pushed from a housing. Such U.S. Pat. Nos. are 1,801,464; 2,054,826; 2,610,732; 4,888,667, and 4,804,286. Other patents related to toys are U.S. Pat. Nos. 4,561,854 and 5,624,320.

OBJECTS OF THE INVENTION

It is therefore an object of the present invention to store a piece of candy for consumption and during consumption pictures are displayed which show a transformation from a person to an animal, or any other combination of pictures.

Another object is to provide a candy dispenser which includes lights that display a series of pictures which illustrate a transformation from one object to another.

Still another object is to provide a toy device by which a person can amuse themselves after a piece of candy has been consumed.

Other objects and advantages will become obvious to those skilled in the art upon a review of the drawings, specification and claims.

DETAILED DESCRIPTION

Figure 1:
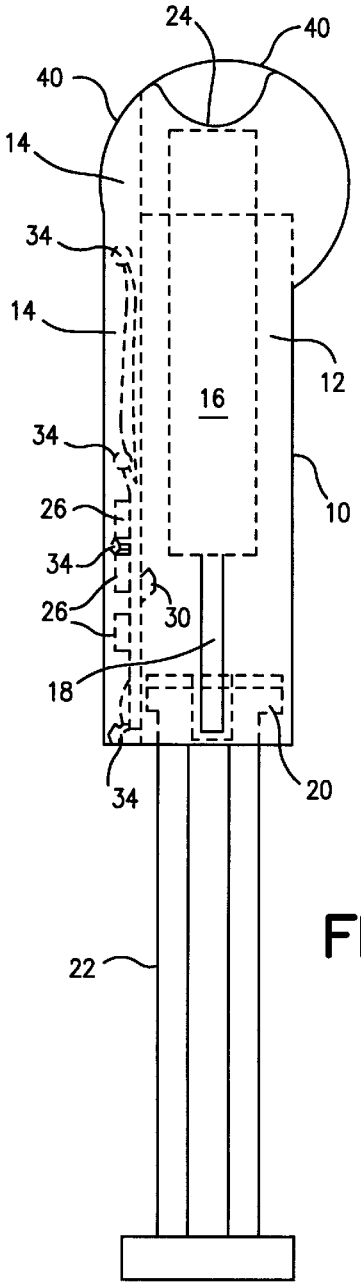
FIG. 1 sets forth a side view of the device in which the inner parts are shown by dotted lines.

Now referring to the drawings, there is shown in FIG. 1 a side view of the device with the several operative parts shown in dotted line. As shown, the device includes a housing 10 having a primary chamber 12 and a secondary chamber 14. The secondary chamber is made of clear plastic and has a translucent covering along its length to allow light to pass through. The translucent covering is provided with a series of pictures thereon which transform one form to another form. The primary chamber includes an axial aperture which includes a piece of candy 16, a candy stick 18 which secures the piece of candy to a candy stick holder 20 which is formed by an upper end of a lower housing 22. The lower housing 22 is used to push the piece of candy up through the primary chamber of the housing and out through an aperture 24 in the upper end of the housing. The lower housing has a length sufficient to push the candy entirely from the primary chamber so that the entire piece of candy can be consumed. Once the piece of candy has been consumed, the stick can be removed and a new piece of candy can be secured in place in the candy stick holder for future use.

The secondary chamber includes a power supply 26 formed by three L736 power supply cells for supplying power to an integrated circuit 28. The power supply is controlled by an on-off switch 30 which activates the electrical circuit. The end of the on-off switch extends into the primary chamber near the bottom so that the switch is operated to an on position by the upper end of the lower housing as the lower housing is raised and the switch is switched off when the lower housing is lowered to its normal lower rest position. The secondary chamber includes the complete electrical circuitry which includes the three L736 power supply cells, one integrated circuit, and four LED lights 34. The four LED lights are spaced on a line along the length of the secondary chamber 16 of the main housing.

Figure 3:
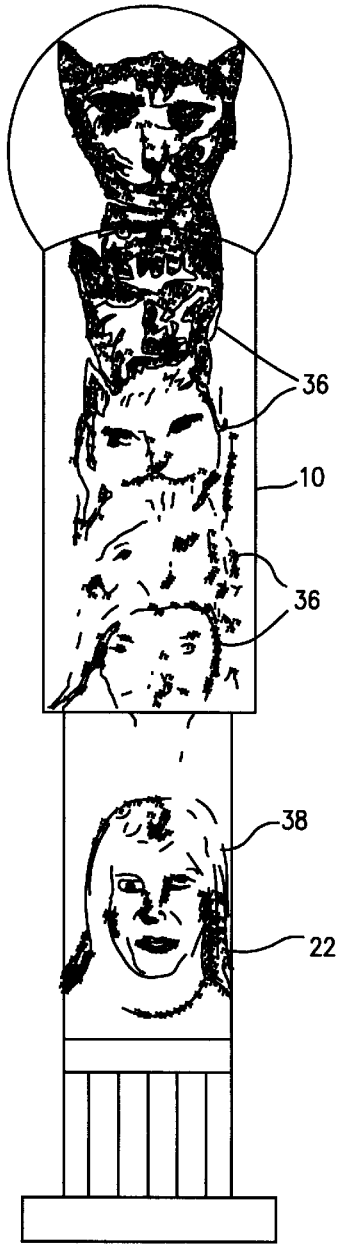
FIG. 3 is a front view which illustrates transforming pictures on the lower housing and along a length of a translucent covering of the secondary chamber.
Figure 2:
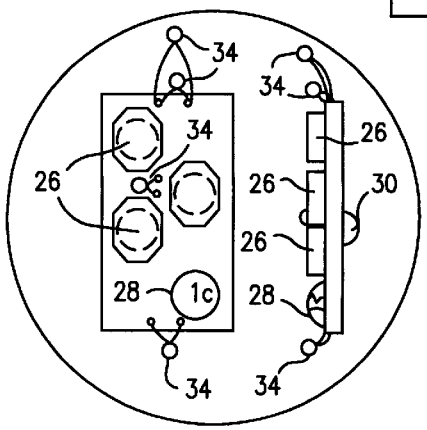
FIG. 2 illustrates a front and side view of parts of the electrical control circuit.

As shown in FIG. 3, the secondary chamber is provided with a translucent housing which has fixed thereon a series of transforming pictures 36 along its length from the bottom to the upper end with the LED lights behind the transforming pictures which are on the translucent surface of the secondary housing 14. To start with, the upper portion of the lower housing is provided with a full-sized picture 38 and the pictures along the secondary chamber have an appearance of being transformed from the full-sized picture of one form to a different full-sized picture of another form, as shown in the drawing.

To consume the candy and to display the transforming pictures, the lower housing is raised. As the lower housing is raised, the upper end 20 of the lower housing contacts the electrical switch which is pressed to "on" to activate the electrical circuitry. The LED lights will flash in order from the bottom of the secondary chamber to the upper end of the chamber so that the full-faced picture 38 of a person as shown by the lower housing will appear to be transformed to an animal by the flashing lights. When the lower housing is lowered, the candy seat triggers the switch and the electrical circuitry is inactivated.

A cap 40 can be provided to cover the aperture 24 in the upper end of the housing in order to protect the candy piece from a contaminating material. Of course, the cap will be removed or moved aside the aperture in order to expose the candy piece.

It will be obvious to one skilled in the art that the transforming pictures can be on the inside of the secondary chamber, on the outside surface of the secondary chamber or on a separate piece of translucent covering secured to the surface of the secondary chamber.

The foregoing relates to preferred exemplary embodiments of the invention, it being understood that other variants and embodiments thereof are possible within the spirit and scope of the invention, the latter being defined by the appended claims.

We claim:

1. A morphing candy holding device which comprises a housing (10), a primary chamber (12) and a parallel secondary chamber (14) provided in said housing, said primary chamber forms an aperture (24) in which a piece of candy is stored and from which a piece of candy (16) is pushed by an upper end of a lower housing (22), said lower housing includes a candy stick holder (20) on an upper end inside the primary chamber, the secondary chamber includes an electrical circuitry, a power source (26) and a switch (30) which protrudes into the primary chamber for activating the electrical circuitry, said electrical circuitry is activated by pushing said lower housing upwardly which contacts the switch to activate the circuitry.

2. A morphing candy holding device as set forth in claim 1, in which said electrical circuitry includes a plurality of power supply cells (26), an integrated circuit (28), and a plurality of LED lights.

3. A morphing candy holding device as set forth in claim 2, which includes a plurality of different successive pictures which extend from a bottom of said secondary chamber to an upper end of said secondary chamber, and said LED lights are aligned within said secondary chamber for shining light through said different successive pictures.

4. A morphing candy holding device as set forth in claim 3, in which said different successive pictures are formed on an outer surface of said secondary chamber.

5. A morphing candy holding device as set forth in claim 4, which includes a covering for said aperture (24).

6. A morphing candy holding device as set forth in claim 3, in which said outer surface of said secondary chamber is a translucent covering.

7. A morphing candy holding device as set forth in claim 6, which includes a covering for said aperture (24).

8. A morphing candy holding device as set forth in claim 3, which includes a covering for said aperture (24).

9. A morphing candy holding device as set forth in claim 2, which includes a covering for said aperture (24).

10. A morphing candy holding device as set forth in claim 1, which includes a covering for said aperture (24).

* * * * *